US005752683A

United States Patent [19]

Novis et al.

[11] Patent Number: 5,752,683

[45] Date of Patent: May 19, 1998

[54] ARM SUPPORT DEVICE

[75] Inventors: David Novis, Burlington; Michael Booth, Newmarket, both of Canada

[73] Assignee: Global Upholstery Company, Downsview, Canada

[21] Appl. No.: 559,698

[22] Filed: Nov. 15, 1995

[51] Int. Cl.[6] ..... A47C 7/54

[52] U.S. Cl. ..... 248/118; 248/218.1; 248/279.1; 297/411.36

[58] Field of Search ..... 248/118, 118.1, 248/118.3, 278.1, 279.1, 283.1, 285.1; 297/411.36, 411.37, 411.38, 411.2

[56] References Cited

U.S. PATENT DOCUMENTS

| | | | |
|---|---|---|---|
| 4,277,102 | 7/1981 | Aaras et al. | 297/411 |
| 4,576,351 | 3/1986 | Brink | 248/118 |
| 4,822,103 | 4/1989 | Stenvall | 297/411 |
| 4,961,610 | 10/1990 | Reeder et al. | 297/412 |
| 5,074,501 | 12/1991 | Hölttä | 248/118.3 |
| 5,135,190 | 8/1992 | Wilson | 248/118.1 |
| 5,143,422 | 9/1992 | Althofer et al. | 297/411.38 |
| 5,161,760 | 11/1992 | Terbrack | 248/118 |
| 5,265,938 | 11/1993 | Melhuish et al. | 297/411.36 |
| 5,281,001 | 1/1994 | Bergsten et al. | 297/411.24 |
| 5,318,347 | 6/1994 | Tsang | 297/411.2 |
| 5,368,365 | 11/1994 | Feldberg | 297/411.38 |
| 5,369,805 | 12/1994 | Bergsten et al. | 297/411.35 |
| 5,380,065 | 1/1995 | Rohrer | 297/411.37 |
| 5,382,079 | 1/1995 | Wilson et al. | 297/411.36 |
| 5,393,124 | 2/1995 | Neil | 297/411.35 |
| 5,407,249 | 4/1995 | Bonutti | 297/411.35 |
| 5,536,070 | 7/1996 | Lemmen | 297/411.2 |
| 5,571,274 | 11/1996 | Holstensson | 297/411.36 |

*Primary Examiner*—Ramon O. Ramirez
*Assistant Examiner*—Kimberly Wood
*Attorney, Agent, or Firm*—Philip Mendes da Costa; Berkesin & Parr

[57] ABSTRACT

A support device for supporting the forearm of a worker in a generally horizontal plane comprising:

(a) an attachment member for affixing the support device to a support member;

(b) a lower support member having a forward end and a rearward end, the rearward end being pivotally mounted to the attachment member for free pivotal rotation of the forward end of the lower support member within an arc with respect to the attachment member due to force applied to the lower support member when the arm of the worker is moved in the horizontal plane; and, (c) an upper longitudinally extending support member for supporting the forearm of a worker, the upper member having a forward end and a rearward end, the upper support member being slidably mounted on the lower support member for movement of the upper support member in the longitudinal direction between a recessed position and an extended position with respect to the lower support member due to force applied to the upper support member when the arm of the worker is moved forwards or rearwards.

26 Claims, 10 Drawing Sheets

ARM SUPPORT DEVICE

FIELD OF THE INVENTION

This invention relates to an arm support device for providing support to the arm of the worker who is performing work with their hands.

BACKGROUND OF THE INVENTION

Repetitive strain injuries cost businesses significant amounts in terms of lost time, lost productivity as well as in compensation claims. Some workers who suffer from a repetitive strain injury may never return to full productivity. Others may return to full productivity only after substantial amounts of time off work as well as substantial amount of therapy.

Repetitive strain injuries are developed by people who routinely perform repetitive tasks. For example, many office workers typically spend many hours a day working at a computer (e.g. typing, data entry and the like).

A common form of repetitive strain injury is Carpal Tunnel Syndrome. Carpal Tunnel Syndrome attacks the tendons in the carpal tunnel of the wrist. If too much stress is placed on the hand while repetitive tasks are performed, then these tendons may become inflamed and press on the medium nerve. Such stress may occur when a worker spends multiple hours working at a computer, typewriter or the like without adequate support being provided for the arm of the user.

Carpal Tunnel Syndrome causes some people to experience numbness and burning while others may have trouble picking objects up. Generally, regardless of the symptoms, a worker may have to be temporally reassigned to other duties or given time off work to recover to reduce the inflammation.

Wilson (U.S. Pat. No. 5,135,190) discloses an articulating ergonomic system. The system is designed to support an individual's forearm, wrist and palm while performing repetitive tasks such as operating the keyboard of a computer. Wilson utilizes a complicated mechanism which has multiple controls that may have to be adjusted in order to position the arm support at the desired position. One problem with the device of Wilson is that it uses multiple moving parts to provide a mobile arm support surface. These parts may be prone to wear. Further, multiple controls are required in order to control the multiple moving parts and to thus position the arm. Further, the arm support has many exposed surfaces which may cause injuries to a worker and is not aesthetically pleasing.

Stenvall (U.S. Pat. No. 4,822,103) discloses a further arm rest device. The device of Stenvall utilizes an adjustable horizontal guide rail, an adjustable vertical guard rail and a joint of elastic material. The adjustable horizontal guide rail is attached to the support for the arm and provides longitudinal movement for the arm rest device. The adjustable vertical guide rail allows the height of the arm support to be automatically adjusted due to the influence of a force generated by the weight of the forearm and by external forces exerted on the forearm. The elastic joint is arranged to allow the horizontal guide rail to tilt in order to provide a corresponding adjustment of the arm rest due to the action of forces applied on the arm rest by the arm of the worker. One problem with the device of Stenvall is that the use of an elastic joint requires the worker to apply pressure in order to turn or tilt the support. When performing repetitive tasks for several hours, this can cause unnecessary strain on the arm of the worker.

Althofer et al (U.S. Pat. No. 5,143,422) discloses an adjustable active arm support for keyboard operators. The arm support is vertically adjustable, laterally adjustable and pivots horizontally and vertically. One problem with the device of Althofer et al is that multiple controls are required to adjust the positioning of the arm. Accordingly, a worker would have to spend much time individually adjusting the position of the arm. Further, once the arm is set, the effective work area which is permitted to the worker would be limited without additional or continual adjustment to the arm rest device.

SUMMARY OF THE PRESENT INVENTION

In accordance with the instant invention there is provided a support device for supporting the forearm of a worker in a generally horizontal plane comprising:

(a) attachment means for affixing the support device to a support member;

(b) a lower support member having a forward end and a rearward end, the rearward end being pivotally mounted to the attachment means for free pivotal rotation of the forward end of the lower support member within an arc with respect to the attachment means due to force applied to the lower support member when the arm of the worker is moved in the horizontal plane; and, (c) an upper longitudinally extending support member for supporting the forearm of a worker, the upper member having a forward end and a rearward end, the upper support member being slidably mounted on the lower support member for movement of the upper support member in the longitudinal direction between a recessed position and an extended position with respect to the lower support member due to force applied to the upper support member when the arm of the worker is moved forwards or rearwards.

In one embodiment, the support device may include a palm support member positioned forward of the forward end of the upper support member. The support device may comprise pivotal mounting means for pivotally mounting the palm support member on the upper support member, the palm support member being movable between a raised position in which the palm support member is positioned forward of the forward end of the upper support member and a lowered position in which the palm support member is retracted beneath the upper support member, the pivotal mounting means having locking means for locking the palm support member in the raised position.

In an alternate embodiment, the support device may include upper support member longitudinal locking means for releasably locking the upper support member in the recessed position. This longitudinal locking means may comprise male and female engagement members, one of the male and female engagement members being positioned on the palm support member and the other of the male and female engagement members being positioned on the lower support member, the male and female members engaging when the palm support member is in the lowered position.

In a further alternate embodiment, the support device may include height adjustment means for adjusting the height of the upper support member. For example, the support member to which the attachment means is affixed may be a chair. Thus, the height of the upper support member may be adjusted so as to be the appropriate position to the height of each individual worker.

In a further alternate embodiment, the support device may include upper support member pivotal locking means for releasably locking the upper support member in a preset position within its arc of movement. The pivotal locking means may comprise male and female engagement members, one of the male and female engagement members being positioned on the upper support member and the other of the male and female engagement members being positioned on the attachment means, the male and female members engaging when the upper support member is in the recessed position and the preset position.

The instant support device provides a support for the arm of a worker which is freely movable in a plane. For example, if the arm is mounted in a generally horizontal position, then the arm support is freely movable longitudinally (forwardly and rearwardly) as well as sideways (i.e. to the right or to the left). Despite using a relatively small number of moving parts, the device is capable of providing support to a worker over a relatively large area.

DESCRIPTION OF THE DRAWING FIGURES

These and other advantages of the instant invention will be more fully and completely understood in accordance with the following description of a preferred embodiment of the invention in which.

Figure 2:
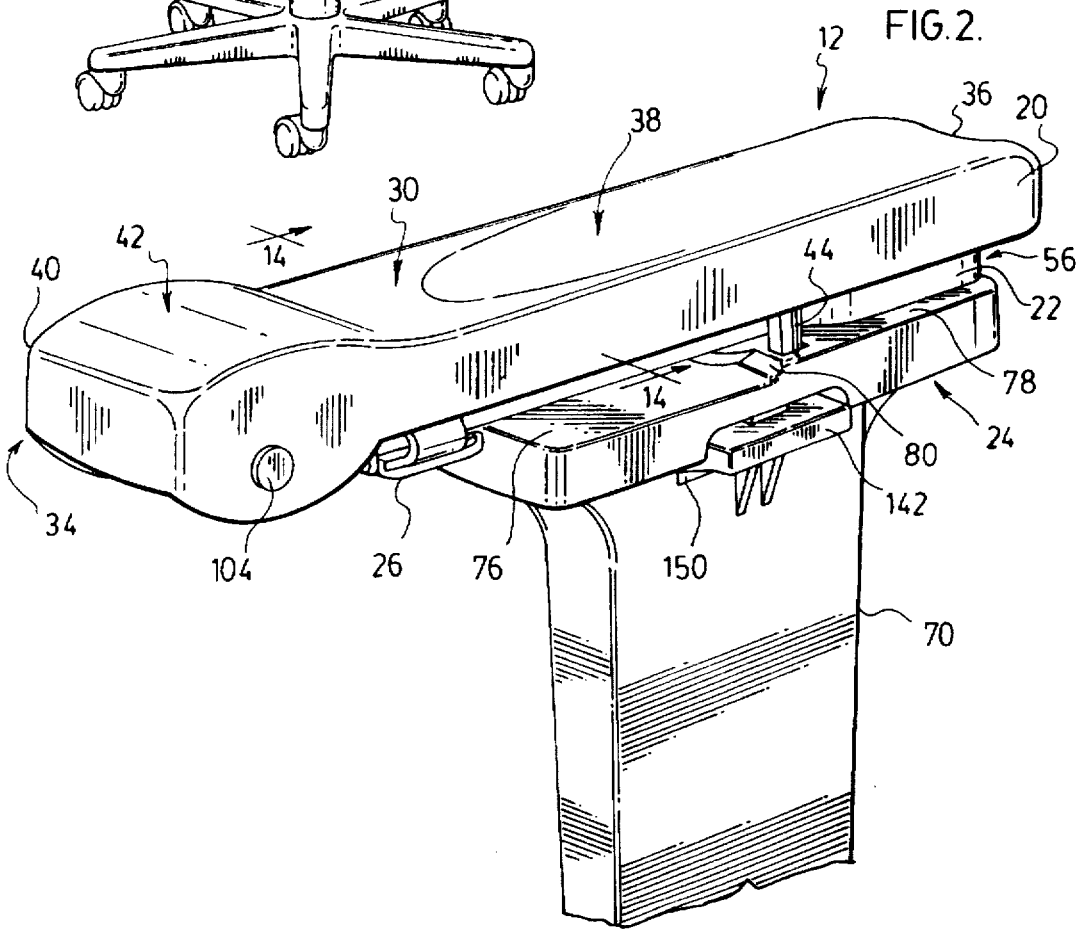
FIG. 2 is a perspective view from the front and to one side of the arm support device of FIG. 1.
Figure 5:
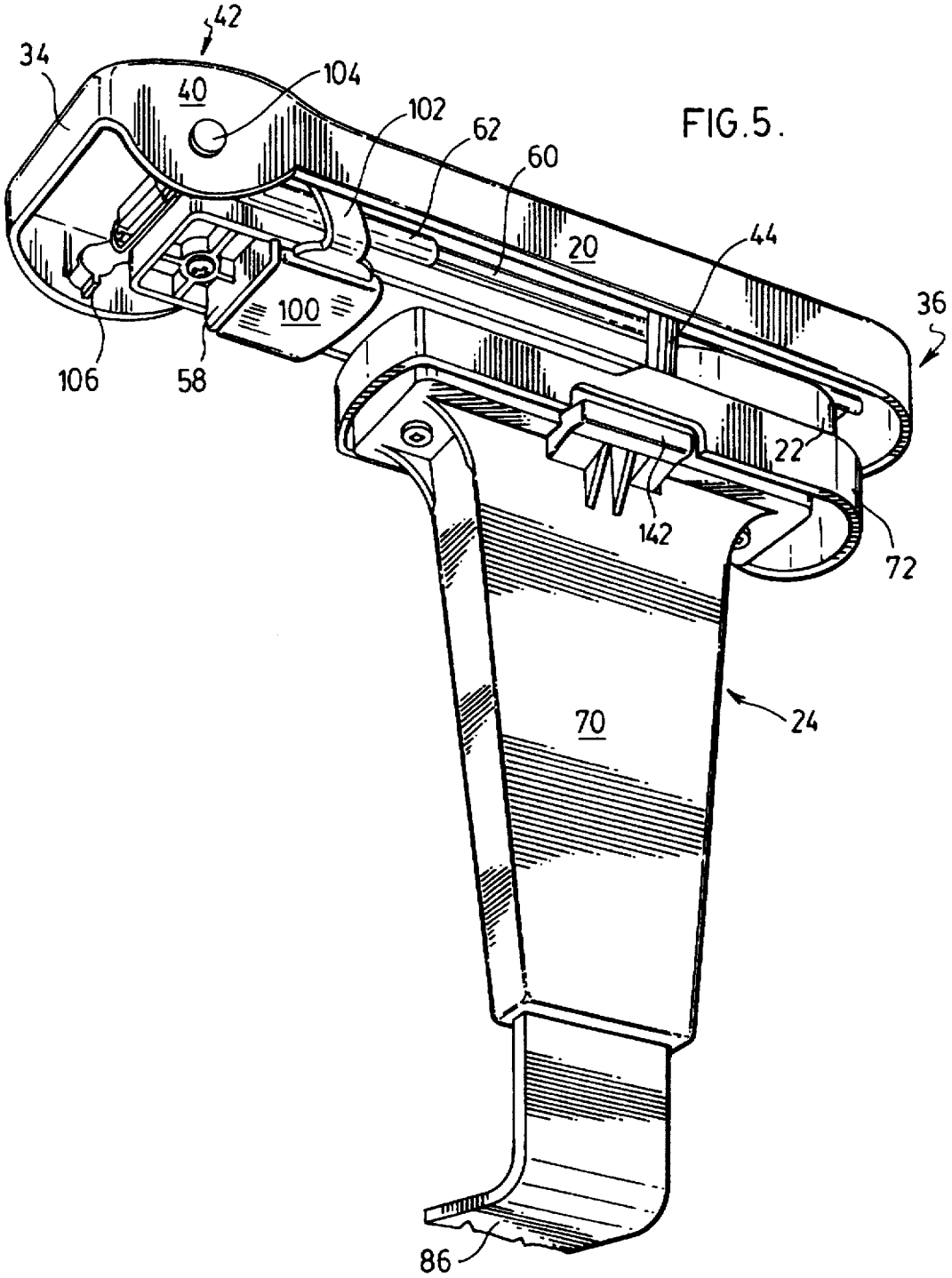
FIG. 5 is a bottom view of the arm support device of FIG. 2 when the arm support device is in the recessed and preset position.
Figure 5A:
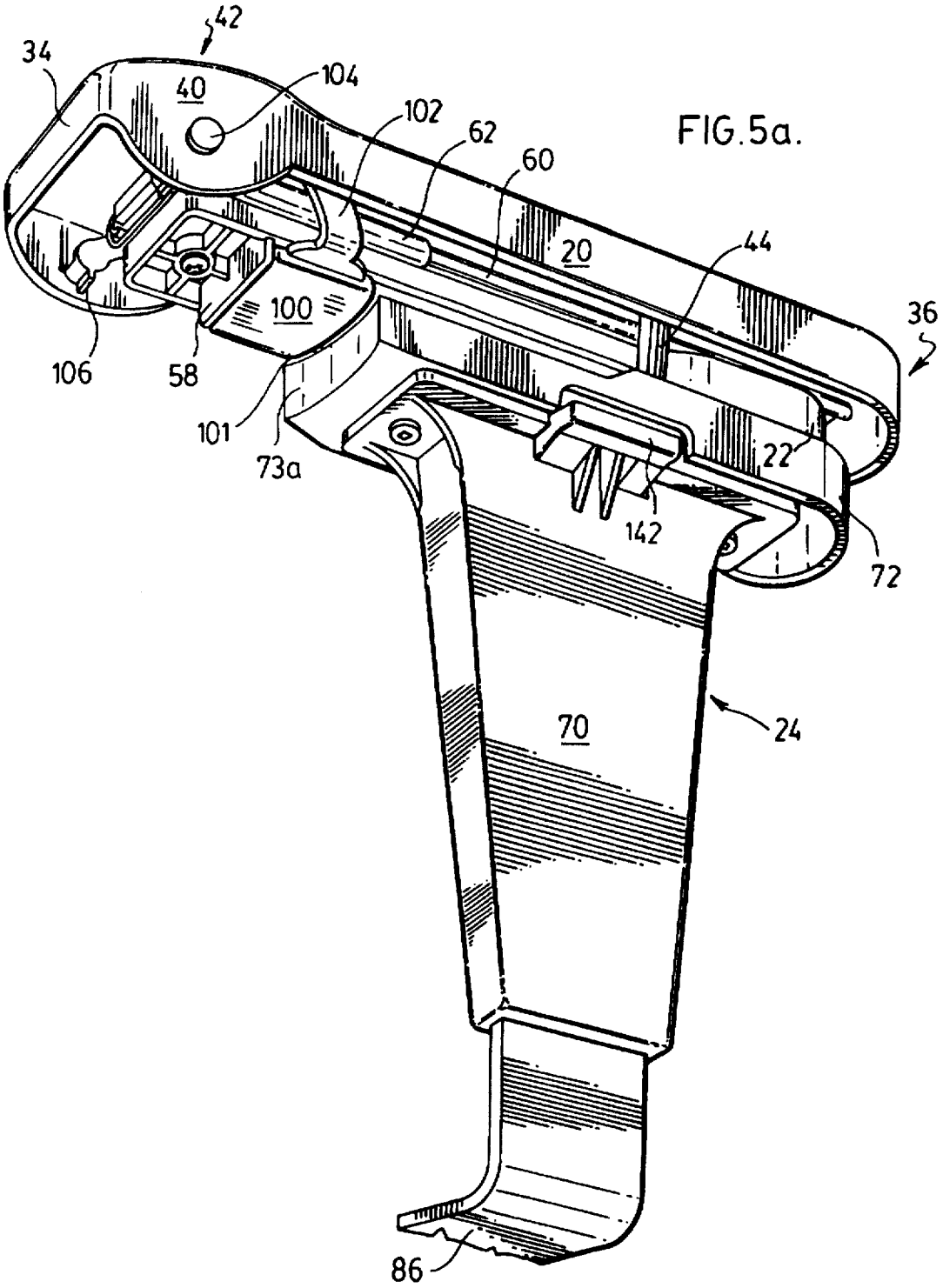

FIG. 5*a* is a bottom view of an alternative embodiment of the arm support device of FIG. 2 when the arm support device is in the recessed and preset position.

Figure 6:
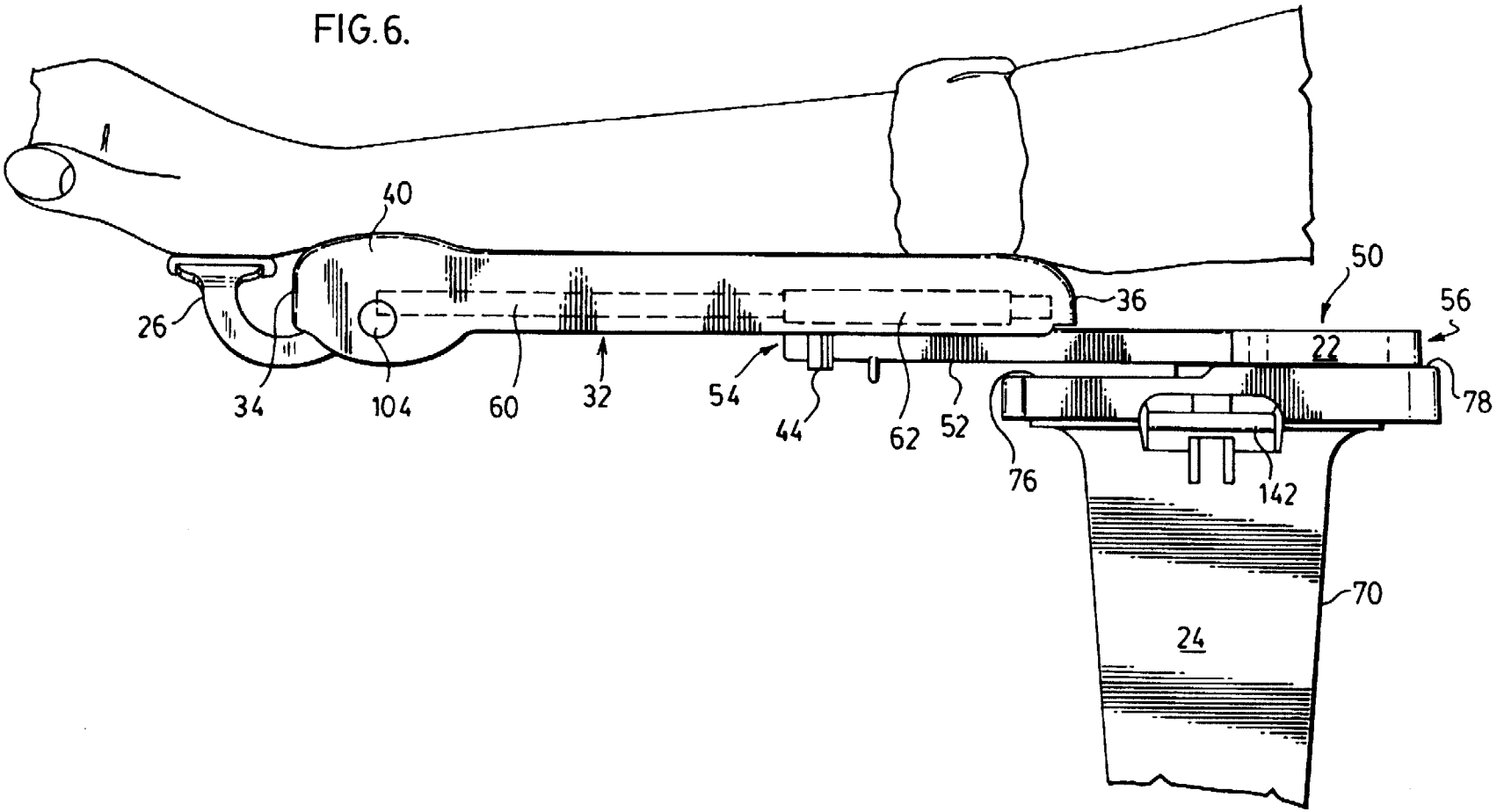
Figure 7:
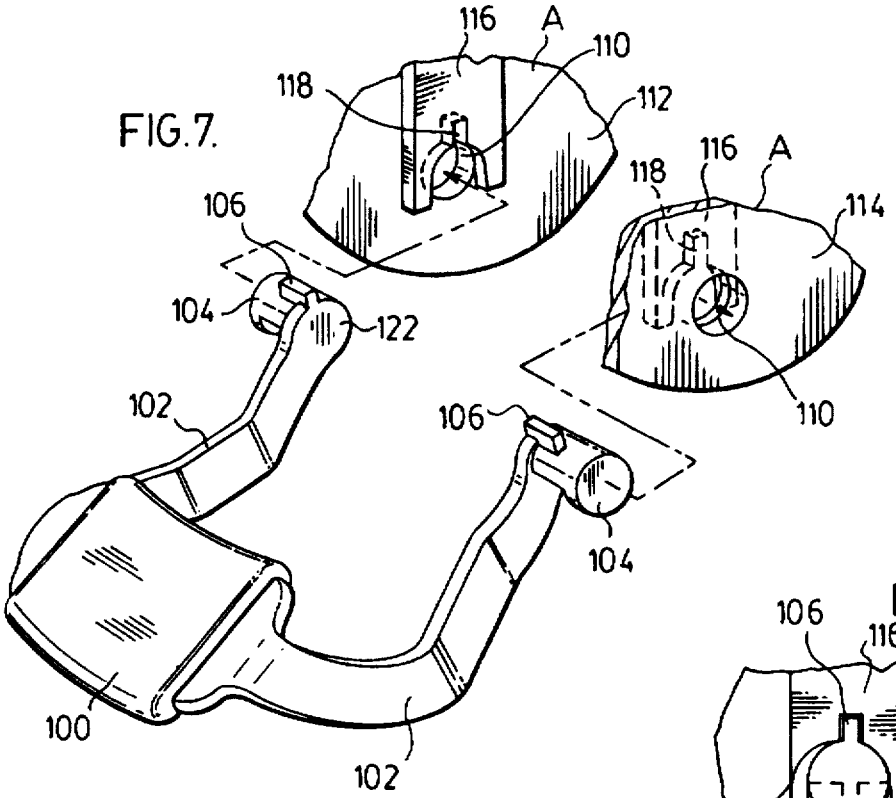
Figure 8:
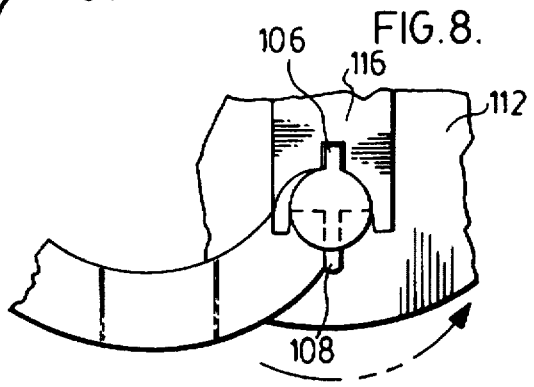
Figure 9:
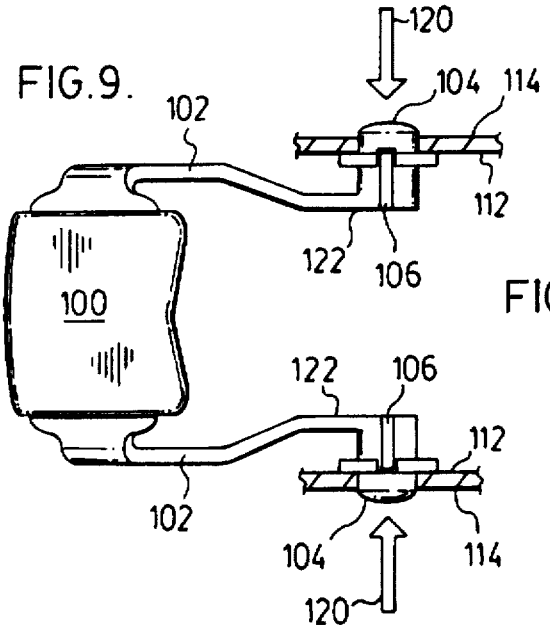
Figure 10:
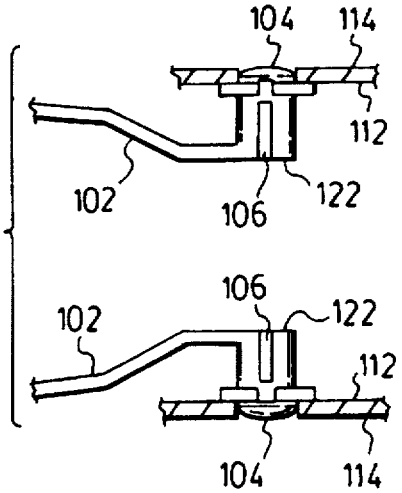
Figure 11:
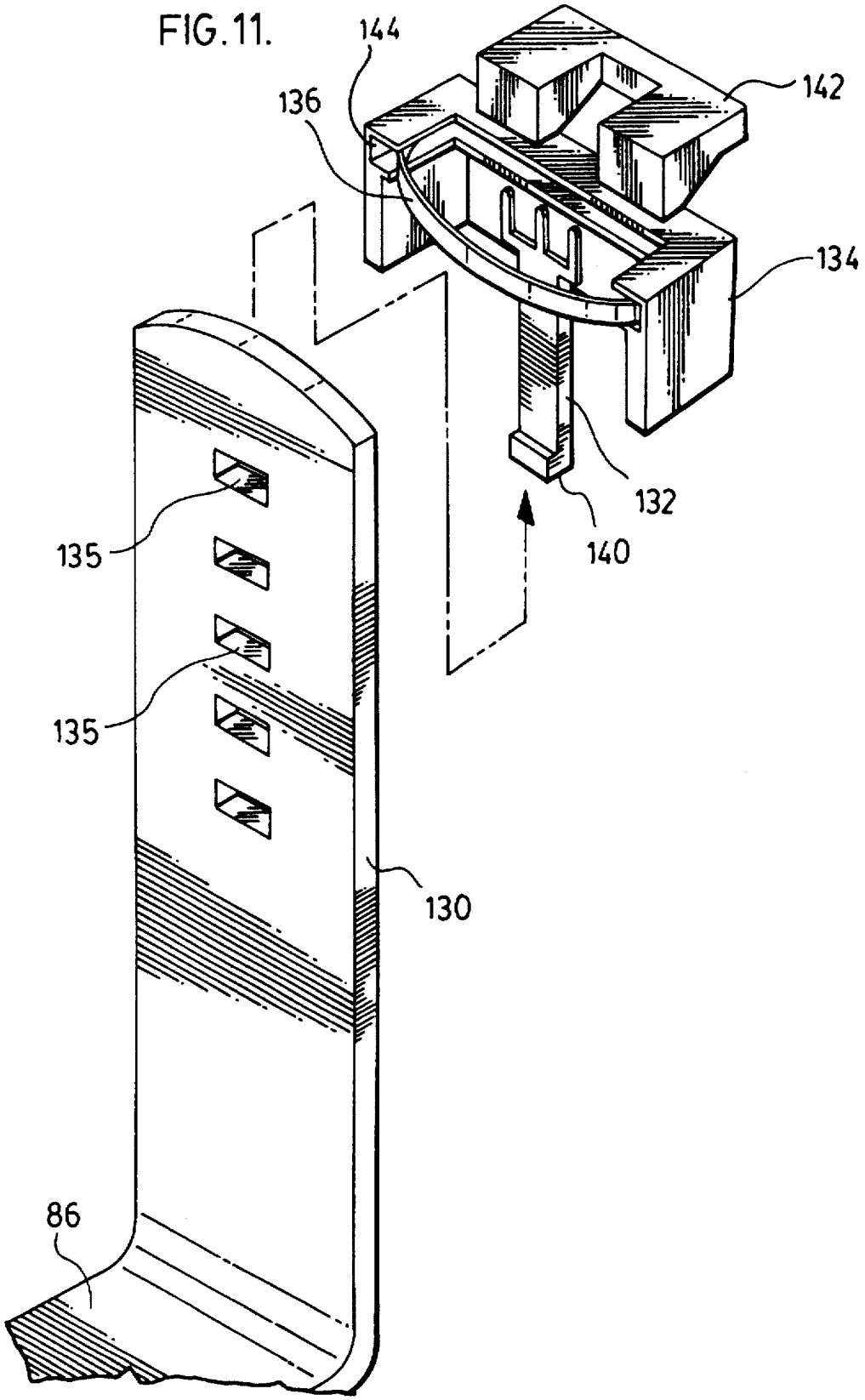
Figure 12:
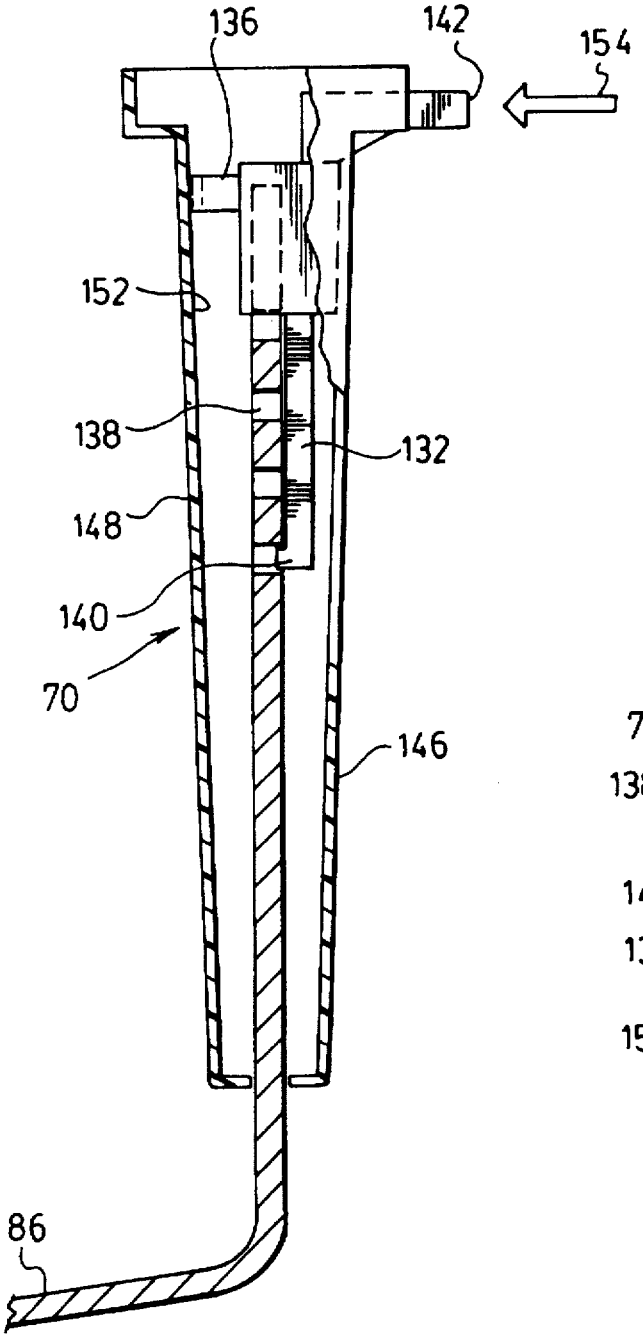
Figure 13:
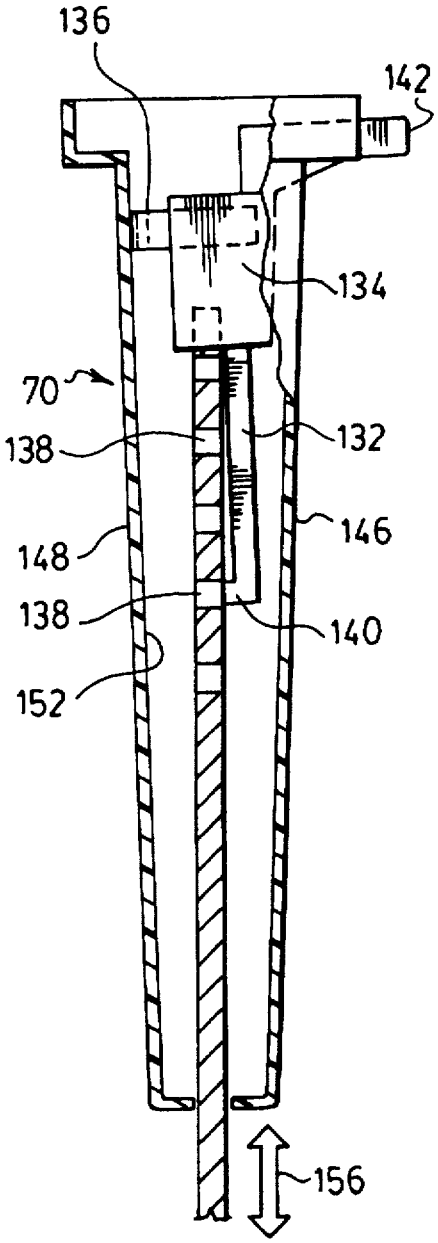
Figure 14:
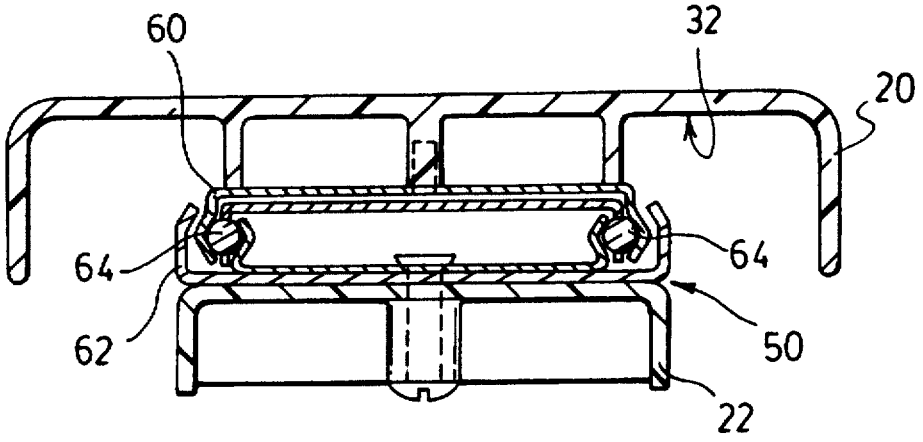

FIG. 6 is side view of the arm support device of FIG. 2 showing the arm support device in use by a worker;

FIG. 7 is an exploded view of the palm support pivot means of the support device of FIG. 2;

FIG. 8 is an enlargement of the pivot means of FIG. 7;

FIG. 9 is a top view of the palm support in the raised locked position;

FIG. 10 is a top view of the palm support in the raised, unlocked position;

FIG. 11 is an exploded view of a height adjustment means for the support device of FIG. 2;

FIG. 12 is a side view of the height adjustment means of FIG. 11 with the support device in the locked position and the height adjustment means cover partially removed; and, FIG. 13 is a side view of the height adjustment means of FIG. 11 with the support device in a mobile position and the height adjustment means cover partially removed; and, FIG. 14 is a cross section along the line 14—14 in FIG. 2.

DESCRIPTION OF PREFERRED EMBODIMENT

Figure 1:
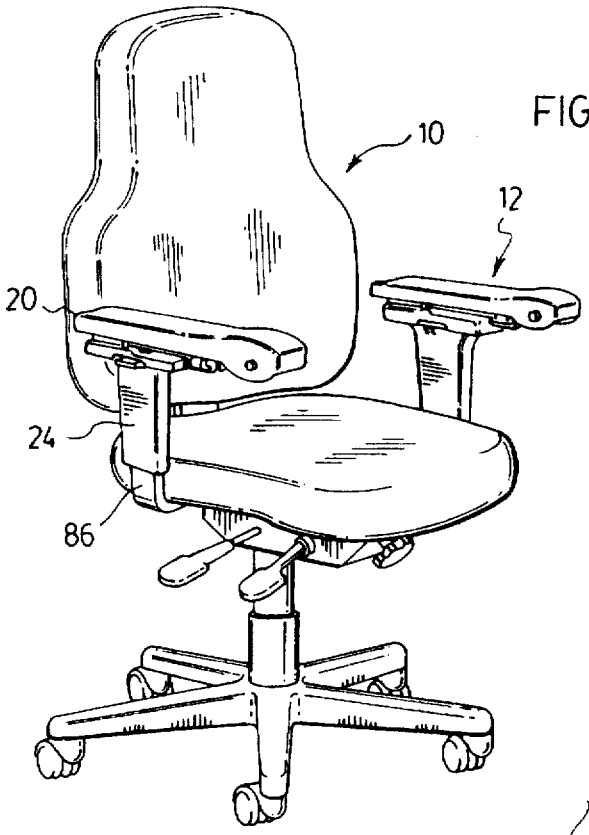
FIG. 1 is a perspective view of a chair to which the arm support device is mounted.

Referring to FIG. 1, support device 12 is shown mounted on chair 10. When so mounted, support device 12 may be used as an arm rest for chair 10.

As shown in FIG. 2, support device 12 comprises upper support member 20, lower support member 22, attachment means 24 and palm support 26.

Referring to FIGS. 2 and 6, upper support member 20 is a longitudinally extending member having an upper surface 30, a lower surface 32, a forward end 34 and a rearward end 36. Lower surface 32 may be provided with pins 44. Pins 44 are located on opposite sides of upper support member 20 adjacent rearward end 36 thereof. Pins 44 extend downwardly from lower surface 32. Upper support member 20 has a sufficient longitudinal extent so as to provide support to the forearm of the user. As shown in FIG. 6, upper support member 20 is of a sufficient longitudinal length so as to provide support to the arm of the user from about the elbow to the wrist. In order to more ergonomicly fit the forearm of a user, upper support member 20 may have a central, recessed portion 38 so that, in cross-section, support member 20 is generally concave. Accordingly, the shape of upper support member 20 will more closely conform to the shape of the forearm of a user.

In order to provide support to the wrist of the user, forward end 34 of the upper support member may have enlarged portion 40. Enlarged portion 40 is positioned such that, when the forearm of the worker is positioned on the support device, enlarged portion 40 is positioned beneath the wrist of the user (see FIG. 6). Enlarged portion 40 preferably has upper curved surface 42 so as to provide support to the wrist of the user. By providing support to the wrist of the user, enlarged portion 40 decreases the stress placed upon the wrist of the worker when the forearm of the worker is on the arm support.

Figure 3:
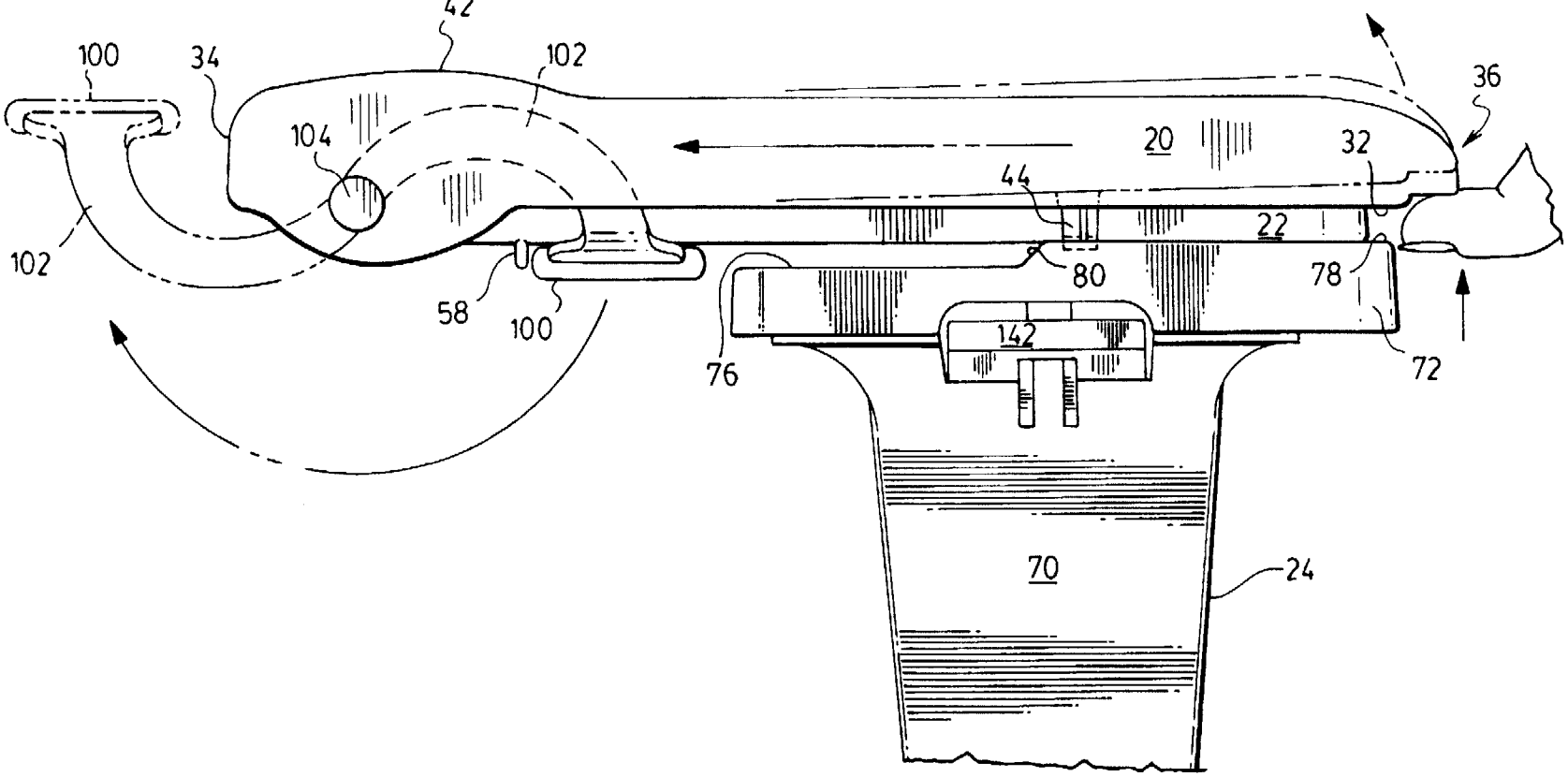
FIG. 3 is a side view of the arm support device of FIG. 2.
Figure 4:
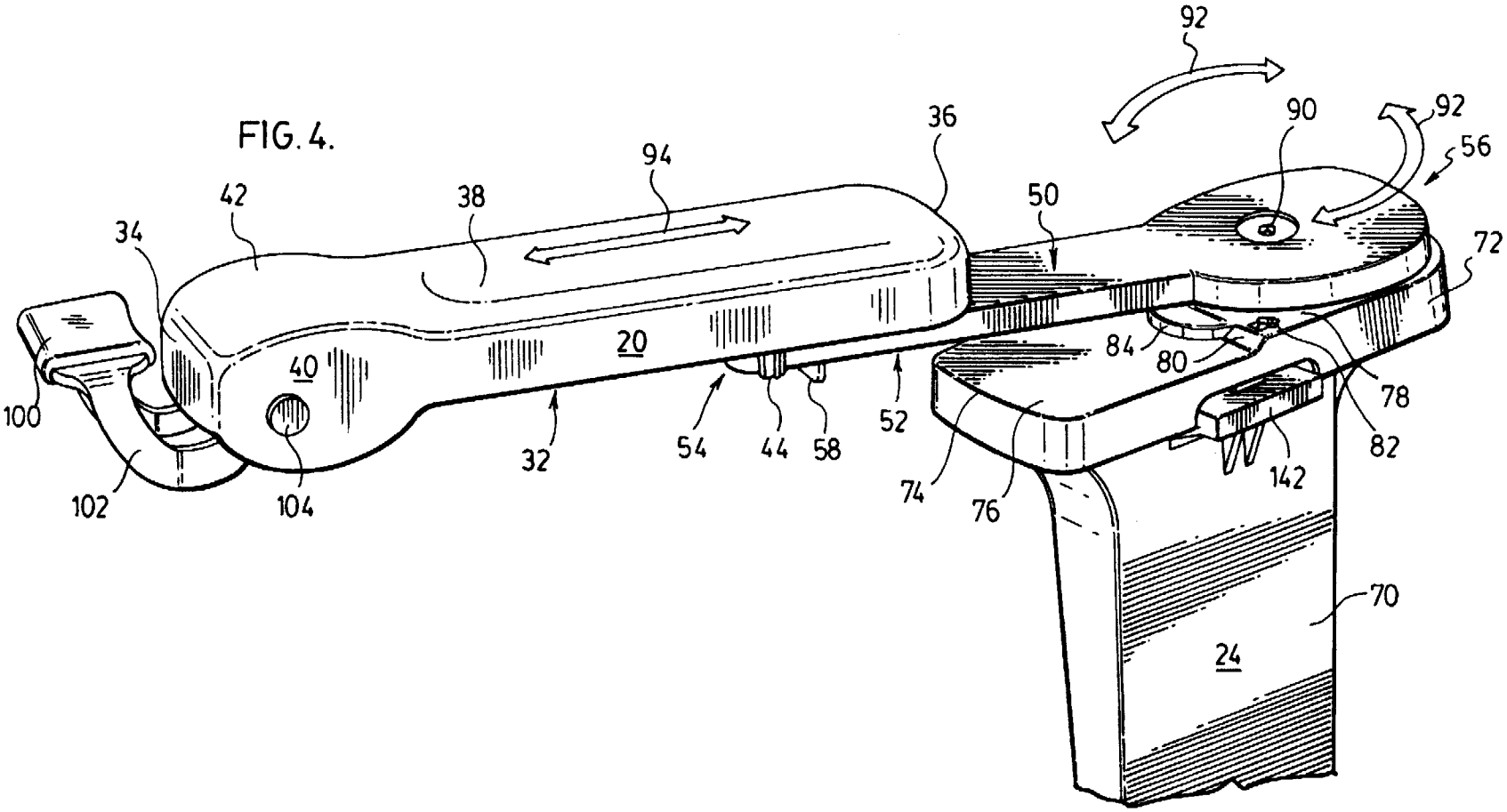
FIG. 4 is a side perspective view of the arm support device of FIG. 2 wherein the arm support device is in the extended position.

Lower support member 22 is positioned beneath upper support member 20. As shown in FIGS. 4 and 6, lower support member 22 has an upper surface 50, a lower surface 52, a forward end 54 and a rearward end 56. As shown in FIG. 3, lower surface 52 of lower support member 22 has wall member 58.

Upper support member 20 is slidably mounted on lower support member 22 for longitudinal movement of upper support member 20. As shown in FIGS. 5, 6 and 14, upper support member 20 may be slidably mounted on lower support member 22 by means of upper slide member 60 and lower slide member 62. Upper slide member 60 is mounted on lower surface 32 of upper support member 20. Lower slide member 62 is mounted on upper surface 50 of lower support member 22 adjacent forward end 54 thereof. Upper slide member mounted 60 is slidably mounted with respect to lower slide member 62 by means of ball bearings 64 as is known in the art. Accordingly, upper support member 20 may freely slide forwardly and rearwardly due to the force applied to upper support member 20 by the forearm of a worker, when the worker's forearm is resting on upper support member 20, as the worker moves their arm forwards or backwards.

Attachment means 24 may comprises vertical member 70 and horizontal member 72. Horizontal member 72 has top surface 74. Top surface 74 may have a forward portion 76 and a rearward portion 78. Rearward portion 78 is vertically displaced with respect to forward portion 76. A cam member 80 is positioned on each opposed side of lower support member 22. Each cam member 80 extends upwardly from forward portion 76 to rearward portion 78. Extending between opposed cam members 80 is guard wall 84. Guard wall 84 is preferably about the same height as the vertical distance between forward portion 76 and rearward portion 78. Recesses 82 may be provided on each opposed side of rearward portion 78 adjacent cam members 80. Each recess 82 is sized so as to receive a pin 44.

Attachment portion 86 is positioned at the lower end of vertical member 70. As shown in FIGS. 1 and 5, attachment portion 86 may be used to affix support device 12 to a support member such as chair 10 or a desk or other work surface. Attachment portion 86 may be affixed to the support member by any means known in the art. For example, attachment portion 86 may comprise a flange or the like which may be bolted or the like to chair 10 according to methods which are known to the art.

Rearward end 56 of lower support member 22 may be pivotally mounted to attachment means 24 by any means known in the art. Preferably, rearward end 56 is pivotally mounted to the rearward end of horizontal member 72. As shown in FIG. 4, pivot means 90 is preferably positioned adjacent rearward end 56 of lower support member 22. A recess may be provided in rearward end 56. Pivot means 90 may comprise a screw which extends through lower member 22 and horizontal member 72. A bolt or similar device may be positioned on the bottom end of the screw below top surface 74 (not shown).

Due to pivot means 90, lower support member 22 is pivotally mounted so as to move to the left or right with respect to attachment means 24. Referring to FIG. 4, lower support member 22 may be able to rotate either clockwise or counter clockwise in the direction shown by arrows 92. As upper support member 20 is mounted above lower support 22, support may be provided to the arm of the worker as the worker moves their arm to the left or the right within the plane of motion defined by lower support member 22 and pivot means 90. For example, if the worker is sitting in a chair and lower support member 22 is horizontally disposed, the worker may easily swivel upper support member 20 to the left or the right without undue stress being placed on their arm.

It will also be appreciated that, due to slidable mounting means 60, 62 and 64, upper support member 20 may move longitudinally forward or rearwardly in the direction shown by arrow 94 (see FIG. 4). It will further be appreciated that both the longitudinal movement and the side to side pivot movement may occur at the same time. Thus, support device 12 provides support to the arm of a worker over a relatively large work area. For example, it will be appreciated that a data entry operator will have to move their hands laterally to the left or the right as they are entering data into a computer, e.g. typing or using a mouse. As the worker moves their hands laterally, the distance between the worker's hand and the keyboard and/or the mouse will increase or decrease. Due to slidable mounting means 60, 62 and 64, upper support member 20 automatically responds to the movement of the worker and moves to support the forearm of the worker. Thus, the worker does not have to strain as they work on any particular part of the keyboard.

As shown in FIG. 7, support device 12 may optionally include palm support 26. Palm support 26 comprises pad portion 100 and arms 102. Arms 102 are positioned on opposed sides of pad 100 and extend rearwardly thereof. Pivot pins 104 are provided at the rearward ends of arms 102. Each pivot pin 104 has a first protrusion 106 and an opposedly positioned second protrusion 108 (see FIG. 8). Palm support 26 is preferably pivotally mounted for movement between a raised position in which palm support 26 is positioned forward of forward end 34 of upper support member 20 (see FIG. 6) and a lowered position in which palm support 26 is retracted beneath upper support member 20 (see FIG. 5). When the worker places their wrist on pad portion 100, a downward force is applied to palm support 26. Accordingly, if palm support 26 is pivotally mounted, then pivotal locking means for locking palm support 26 in the raised position is provided.

Area A of FIG. 7 is a cut out portion of the side walls of upper support member 20. According to the preferred embodiment, the side walls have an inner side 112 and an outer side 114. An opening 110 is provided in each side wall between inner side 112 and outerside 114. Each opening 110 is positioned and sized so as to receive a pivot pin 104. Each inner side 112 is also provided with a raised portion 116. Each raised portion 116 has a recess 118 positioned therein. Recess 118 extends from the surface of raised portion 116 partway towards outer side 114. Each recess 118 is sized so as to receive at least a portion of first and second protrusions 106 and 108. Recesses 118 and protrusions 106 comprise the pivotal locking means for palm support 26.

When palm support 26 is in the raised position (FIG. 6), protrusions 106 extend into recess 118 and pivot pins 104 extend outwardly past outer surface 114 (see FIG. 9). As protrusions 106 extend into recesses 118, the contact between the side walls of recess 118 and the side walls of protrusions 106 prevents palm support 26 from rotating. Accordingly, when the user places their wrist on pad portion 100, due to the engagement between protrusions 106 and recesses 118, pad portion 100 is maintained in the raised position shown in FIG. 6.

If it is desired to lower pad portion 100 to the lowered position shown in FIG. 5, the worker presses inwardly on pivot pins 104 in the direction of arrows 120. This results in pivot pins 104 moving to the position shown in FIG. 10. When pivot pins 104 are in this position, protrusions 106 are withdrawn from recesses 118 and palm support 26 may rotate to the lowered position shown in FIG. 5. In this position, protrusions 108, which are oppositely positioned on pins 104, are now in alignment with recesses 118. Accordingly, protrusions 108 now interact with recesses 118 to maintain palm support 26 in the lowered position.

Protrusions 106 and 108 extend axially along pivot pins 104 in the direction of arrow 120. Pivot pins extend axially outwardly from inner surface 122 of arm 102. The length of protrusions 108 in the axial direction may be less than the length of protrusions 106 in the axial direction. Accordingly, the amount of protrusions 108 which extend inwardly into recesses 118 may be less than the amount of protrusions 106 which extend inwardly into recesses 118. If the contact between protrusions 108 and recesses 118 is sufficiently small, then in order to move palm support 26 from the lowered position to the raised position, the worker may merely pull palm support 26 downwardly to disengage protrusions 108 from recesses 118.

Support device 12 preferably includes a longitudinal locking means. The longitudinal locking means may comprise male and female engagement members, one of the male and female engagement members is positioned on upper support member 20 or palm support 26 and the other of the male and female engagement members is positioned on lower support member 22 or attachment means 24. Referring to the drawings, the longitudinal locking means may comprise pad portion 100 and wall member 58. As shown in FIG. 3, when palm member 26 is in the lowered position (as shown in solid outline in FIG. 3), pad portion 100 is positioned behind wall member 58. As wall member 58 is affixed to lower support member 22, and as lower support member 22 does not move longitudinally, forward movement of upper support member 20 is prevented due to the contact between pad portion 100 and wall member 58. When palm support 26 is moved to the raised position (as shown in dotted outline in FIG. 3), pad portion 100 is disengaged from wall member 58. Accordingly, upper support member 20 may move in the direction of the arrow shown in FIG. 3 without hinderance.

Optionally, support device 12 also includes a pivotal locking means. The pivotal locking means may comprise male and female engagement members, one of the male and female engagement members is positioned on upper support member 20 or lower support member 22 and the other of the male and female engagement members is positioned on attachment means 24, the male and female members engaging when upper support member 20 is in the recessed position and the preset position.

As shown in the preferred embodiment of FIGS. 4 and 5, the pivotal locking means may comprise pins 44 and recesses 82. Pins 44 are positioned on upper support member 20 so as to engage recesses 82 when upper support 20 is in the longitudinally recessed position (referred to herein as the recessed position) and when arm member 20 is aligned with horizontal member 72 (referred to herein as the preset position). When upper support member 20 is in this position, the engagement of pins 44 in recesses 82 prevent upper support member 20 from pivoting to the left or the right.

Alternately, or in addition, as shown in FIG. 5*a*, horizontal member 72 may have arcuate shaped forward surface 73. Pad 100 may have arcuate surface 101. Surfaces 73 and 101 are designed to have a complimentary shape. When palm support 26 is in the lowered position, surface 101 abuts against surface 73. Thus, if upper support member 20 is pivoted laterally, one portion of surface 101 will engage one portion of surface 73 thus preventing upper support member 20 from pivoting laterally.

When upper support member is in the recessed and preset position, upper support member may be used as a standard arm rest for a chair. This is the position shown in FIG. 1. When the worker requires arm support for their arm in an extended position, e.g. they will be working on a data entry terminal or computer, the worker may move palm support 26 to the raised position as shown in FIG. 3 (if the optional palm support is provided). Subsequently, the worker may raise the rearward portion of upper support member 20 to the position shown in dotted outline in FIG. 3. Rearward end 36 may pivot upward as lower slide member 62 is positioned at this time adjacent forward end 34 of upper support member 20. When rearward portion 36 is in the raised position shown in FIG. 3, pins 44 are disengaged from recesses 82. The worker may then extend upper support member longitudinally in the direction of the arrow shown in FIG. 3. At the same time, upper support member 20 is freely pivotal.

When the worker is finished with the data entry, upper support member 20 may be pivoted in the horizontal plane so as to be in alignment with horizontal member 72. Upper support member 20 may then be moved longitudinally to the recessed position. As upper support member 20 moves to the recessed position, pins 44 will engage cam member 80 and deflect rearward portion 36 upwardly. Pins 44 will then travel along upper surface 78 until they engage recesses 82. If a different order of closure is utilized, pins 44 may not be aligned with recesses 82 as upper support member 20 is moved rearwardly to the recessed position. If this is the case, then pins 44 will engage guide wall 84. Guide wall 84 prevents upper support member 20 from moving from the fully retracted position unless upper support member 20 is in alignment with horizontal member 72 in which position pins 44 are aligned with recesses 82. Once fully retracted, optional palm support 26 may be pivoted to the lowered position thereby further locking upper support member 20 in the recessed position.

Preferably, support device 12 includes height adjustment means so that the height of upper support member 20 may be customized for each particular worker. A preferred height adjustment means in shown in FIGS. 11–13. FIG. 11 shows an exploded view of the height adjustment means. The height adjustment means may comprise locking member 130, engagement member 132, button member 134 and spring member 136. Locking member 130 has a plurality of vertically disposed openings 138. Engagement member 132 is a vertically disposed member extending downwardly from button member 134. Engagement member 132 has a lower portion 140 which extends horizontally. Lower portion 140 is sized so as to be received in each opening 138. Button member 134 has horizontal button portion 142. Spring means 136 is an arcuate shaped member (e.g a steel ribbon) which is positioned in recess 144 on the rearward side of button member 134.

The height adjustment means is positioned within vertical member 70. Vertical member 70 has outer case member 146 and inner case member 148. As shown in FIG. 2, an opening 150 is provided in outer case member 146 for horizontal button portion 142. Inner case member 148 has inner surface 152. Spring member 136 extends in the inward direction away from button member 134 to contact inner surface 152. The contact between inner surface 152 and spring member 136 provides a compressional force which causes lower portion 140 to pivot inwardly into an opening 138.

When it is desired to change the height of upper support member 20, the worker pushes inwardly on horizontal button portion 142 in the direction of arrow 154. This inner movement causes lower portion 140 to pivot toward outer case 146 and, therefore, out of an opening 138. The worker may then move upper support member 20 upwardly or downwardly. This causes button member 134 to move in a similar direction with respect to locking member 130 (arrow 156). When upper support member 20 is at the desired height, the worker may release horizontal button portion 142. When button portion 142 is released, spring member 136 causes lower portion 140 to pivot towards inner case member 148. Lower portion 140 may then engage an opening 138 and lock upper support member at the desired height.

We claim:

1. A support device for mounting on a support member to support the forearm of a worker in a generally horizontal plane, said support device comprising:

(a) a lower support member having a forward end and a rearward end and extending in a longitudinal direction between said forward end and said rearward end, said rearward end having a pivot member for mounting said lower support member to said support member for free rotation of said forward end of said lower support member within an arc with respect to said support member due to force applied to said lower support member when the arm of the worker is moved in the horizontal plane; and, (b) an upper support member for supporting the forearm of a worker, said upper support member having a forward end and a rearward end and extending in said longitudinal direction, said upper support member being mounted on said lower support member for relative movement of said upper support member with respect to said lower support member only in said longitudinal direction between a recessed position and an extended position due to force applied to said upper support member when the arm of the worker is moved forwards or rearwards;

(c) a palm support member; and, (d) a pivotal mounting member for pivotally mounting said palm support member with respect to said forward end of said upper support member, said palm support member being moveable between a raised position in which said palm support member is positioned forward of said forward end of said upper support member and a lowered position in which said palm support member is retracted beneath said upper support member, said pivotal mounting member having a locking member for locking said palm support member in said raised position.

2. The support device as claimed in claim 1 wherein said support device includes an upper support member longitudinal locking member for releasable locking said upper support member in said recessed position.

3. The support device as claimed in claim 2 wherein said upper support member longitudinal locking member comprises male and female engagement members, one of said male and female engagement members positioned on said palm support member and the other of said male and female engagement members positioned on said lower support member, said male and female members engaging when said palm support member is in said lowered position.

4. The support device as claimed in claim 3 wherein said lower support member has a lower surface, said lower surface has a vertically disposed engagement member and said palm support member is positioned rearward of said engagement member when said palm support member is in said lowered position.

5. The support device as claimed in claim 1 wherein said support member includes a height adjustment member for adjusting the height of said upper support member.

6. The support device as claimed in claim 1 further comprising an upper support member pivotal locking member for releasable locking said upper support member in a preset position within said arc.

7. The support device as claimed in claim 6 wherein said upper support member pivotal locking member comprises male and female engagement members, one of said male and female engagement members positioned on said upper support member and the other of said male and female engagement members positioned on said support member, said male and female members engaging when said upper support member is in said recessed position and said preset position.

8. The support device as claimed in claim 7 wherein said upper support member has a lower surface, said lower surface has a downwardly extending engagement member, said support member has a matting recess to engage said downwardly extending engagement member when said upper support member is in said recessed position and said preset position.

9. The support device as claimed in claim 8 wherein said upper support member is mounted for upward movement of said rearward end of said upper support member, whereby said pivotal locking member is released by upward movement of said rearward end of said upper support member so that said downwardly extending engagement member is withdrawn from said matting recess.

10. The support device as claimed in claim 9 wherein said support member has a cam member to vertically deflect said rearward end of said upper support member as said upper support member is moved to said recessed position.

11. A support device for supporting the forearm of a worker in a generally horizontal plane comprising:

(a) an attachment member for affixing said support device to a support member;

(b) a lower support member having a forward end and a rearward end and extending in a longitudinal direction between said forward end and said rearward end, said rearward end being pivotally mounted to said attachment member for free pivotal rotation of said lower support member within an arc with respect to said support member due to force applied to said lower support member when the arm of the worker is moved in the horizontal plane;

(c) an upper support member for supporting the forearm of a worker, said upper support member having a forward end and a rearward end, said upper support member being mounted on said lower support member for movement of said upper support member in said longitudinal direction between a recessed position and an extended position with respect to said lower support member due to force applied to said upper support member when the arm of the worker is moved forwards or rearwards;

(d) a palm support member positioned adjacent to said forward end of said upper support member;

(e) a pivotal mounting member for pivotally mounting said palm support member with respect to said upper support member, said palm support member being moveable between a raised position in which said palm support is positioned forward of said forward end of said upper support member and a lowered position in which said palm support member is retracted beneath said upper support member, said pivotal mounting member having a locking member for locking said palm support member in said raised position;

(f) an upper support member longitudinal locking member for releasable locking said upper support member in said recessed position, said upper support member longitudinal locking member comprising male and female engagement members, one of said male and female engagement members positioned on said palm support member and the other of said male and female engagement members positioned on said lower support member, said male and female members engaging when said palm support member is in said lowered position; and, (g) an upper support member pivotal locking member for releasable locking said upper support member in a preset position within said arc.

12. The support device as claimed in claim 11 wherein said lower support member has a lower surface, said lower surface has a vertically disposed engagement member and said palm support member is positioned rearward of said engagement member when said palm support member is in said lowered position.

13. The support device as claimed in claim 11 wherein said attachment member includes a height adjustment member for adjusting the height of said upper support member with respect to the support member.

14. A support device for supporting the forearm of a worker in a generally horizontal plane comprising:

(a) an attachment member for affixing said support device to a support member;

(b) a lower support member having a forward end and a rearward end and extending in a longitudinal direction between said forward and the said rearward ends, said rearward end being pivotally mounted to said support member for free pivotal rotation of said forward end of said lower support member within an arc with respect to said support member due to force applied to said lower support member when the arm of the worker is moved in the horizontal plane;

(c) an upper support member for supporting the forearm of a worker, said upper support member having a forward end and a rearward end, said upper support member being mounted on said lower support member for movement of said upper support member in said longitudinal direction between a recessed position and an extended position with respect to said lower support member due to force applied to said upper support member when the arm of the worker is moved forwards or rearwards;

(d) a palm support member positioned adjacent to said forward end of said upper support member (e) a pivotal mounting member for pivotally mounting the palm support member whereby said palm support being movable between a raised position and a lowered position;

(f) an upper support member longitudinal locking member for releasable locking said upper support member in said recessed position; and, (g) an upper support member pivotal locking member for releasable locking said upper support member in a preset position within said arc.

15. The support device as claimed in claim 14 wherein said attachment member includes a height adjustment member for adjusting the height of said upper support member with respect to the support member.

16. The support device as claimed in claim 14 wherein said upper support member pivotal locking member comprises male and female engagement members, one of said male and female engagement members positioned on said upper support member and the other of said male and female engagement members positioned on said attachment member, said male and female members engaging when said upper support member is in said recessed position and said preset position.

17. The support device as claimed in claim 16 wherein said upper support member longitudinal locking member comprises male and female engagement members, one of said male and female engagement members positioned on said palm support member and the other of said male and female engagement members positioned on said lower support member, said male and female members engaging when said palm support member is in said lowered position.

18. The support device as claimed in claim 17 wherein said lower support member has a lower surface, said lower surface has a vertically disposed engagement member and said palm support member is positioned rearward of said engagement member when said palm support member is in said lowered position.

19. The support device as claimed in claim 18 wherein said upper support member has a lower surface, said lower surface has a downwardly extending engagement member, said attachment member has a matting recess to engage said downwardly extending engagement member when said upper support member is in said recessed position and said preset position.

20. The support device as claimed in claim 19 wherein said upper support member is mounted for upward movement of said rearward end of said upper support member, whereby said pivotal locking member is released by upward movement of said rearward end of said upper support member so that downwardly extending engagement member is withdrawn from said matting recess.

21. The support device as claimed in claim 20 wherein said attachment member has a cam member to vertically deflect said rearward end of said upper support member as said upper support member is moved to said recessed position.

22. A support device for mounting on a support member to support the forearm of a worker in a generally horizontal plane, said support device comprising:

(a) an arm support member having a mounting member for mounting said arm support member to said support member, said arm support member being oriented for supporting the forearm of a worker when mounted to said support member, said arm support member having a forward end and a rearward end and extending in a longitudinal direction between said forward and said rearward ends;

(b) a palm support member; and, (c) a pivotal mounting member for pivotally mounting said palm support member with respect to said forward end of said arm support member, said palm support member being moveable between a raised position in which said palm support is positioned forward of said forward end of said arm support member and a lowered position in which said palm support member is retracted beneath said arm support member, said pivotal mounting member having a locking member for locking said palm support member in said raised position.

23. The support device as claimed in claim 22 wherein said arm support member comprises an upper support member and a lower support member, each of said upper support member and said lower support member having a forward end and a rearward end, said upper support member being mounted to said lower support member for movement of said upper support member in said longitudinal direction between a recessed position and an extended position due to force applied to said upper support member when the arm of the worker is moved forwards or rearwards.

24. The support device as claimed in claim 23 wherein said support device includes an upper support member longitudinal locking member for releasable locking said upper support member in said recessed position.

25. The support device as claimed in claim 24 wherein said upper support member longitudinal locking member comprises male and female engagement members, one of said male and female engagement members positioned on said palm support member and the other of said male and female engagement members positioned on said lower support member, said male and female members engaging when said palm support member is in said lowered position.

26. The support device as claimed in claim 25 wherein said lower support member has a lower surface, said lower surface has a vertically disposed engagement member and said palm support member is positioned rearward of said engagement member when said palm support member is in said lowered position.

* * * * *